US011841137B2

(12) United States Patent
Comencini et al.

(10) Patent No.: US 11,841,137 B2
(45) Date of Patent: Dec. 12, 2023

(54) COMBUSTION HEAD FOR A BURNER

(71) Applicant: RIELLO S.p.A., Legnago (IT)

(72) Inventors: Flavio Comencini, Legnago (IT); Andrea Dalla Benetta, Legnago (IT); Filippo Marconcini, Vigasio (IT); Roberto Marchetti, Pescantina (IT)

(73) Assignee: Riello, S.P.A.

( * ) Notice: Subject to any disclaimer, the term of this patent is extended or adjusted under 35 U.S.C. 154(b) by 76 days.

(21) Appl. No.: 17/471,462

(22) Filed: Sep. 10, 2021

(65) Prior Publication Data

US 2022/0082251 A1 Mar. 17, 2022

(30) Foreign Application Priority Data

Sep. 14, 2020 (IT) ..... 102020000021688

(51) Int. Cl.
*F23D 14/58* (2006.01)
*F23D 14/24* (2006.01)

(52) U.S. Cl.
CPC ..... *F23D 14/58* (2013.01); *F23D 14/24* (2013.01)

(58) Field of Classification Search
CPC ..... F23D 14/58; F23D 14/24
USPC ..... 431/182–184, 354
See application file for complete search history.

(56) References Cited

U.S. PATENT DOCUMENTS 5,573,391 A 11/1996 Benson et al.
5,700,143 A * 12/1997 Irwin ..... F23D 17/002 431/182
5,941,698 A 8/1999 Darling et al.
2020/0166208 A1* 5/2020 Te Kaat ..... F23D 14/24

FOREIGN PATENT DOCUMENTS

| | | | |
|---|---|---|---|
| CN | 1865774 | A | 11/2006 |
| CN | 1938101 | A | 3/2007 |
| CN | 104613474 | A | 5/2015 |
| CN | 20482991 | U | 12/2015 |
| CN | 105698174 | A | 6/2016 |
| CN | 206398715 | U | 8/2017 |
| CN | 110145737 | A | 8/2019 |
| CN | 209876922 | U | 12/2019 |
| CN | 110878941 | A | 3/2020 |
| CN | 111023091 | A | 4/2020 |

(Continued)

OTHER PUBLICATIONS

IT 202000021688—Search Report dated May 1, 2021.
CN 20210129237.X, Office Action dated Sep. 28, 2023.

*Primary Examiner* — Vivek K Shirsat
(74) *Attorney, Agent, or Firm* — Aldo Noto

(57) ABSTRACT

A combustion head for a burner is provided with an outer sleeve, which houses, on the inside, a first feeding device to feed a gaseous fuel into an oxidizing air flow fed along the outer sleeve by means of a pneumatic ventilation device, at least one swirl device, which is configured to cause a primary flow $F_1$ of gaseous fuel and oxidizing air flowing out of the outer sleeve to make a helical movement, and at least one feeding channel with an annular shape, which is obtained between the outer sleeve and the swirl device in order to feed a secondary flow $F_2$ of oxidizing air around the primary flow $F_1$; a second feeding device being mounted on the outside of the outer sleeve and being connected to a gaseous fuel source.

14 Claims, 7 Drawing Sheets

(56) References Cited

FOREIGN PATENT DOCUMENTS

| | | | |
|---|---|---|---|
| CN | 2011146484 | U | 7/2020 |
| EP | 0 945678 | A2 | 9/1999 |
| EP | 0945678 | A2 | 9/1999 |
| EP | 1 705 424 | A1 | 9/2006 |
| JP | 3154700 | B1 | 4/2001 |
| KR | 101235638 | B1 | 2/2013 |
| TW | 418304 | B | 1/2001 |

* cited by examiner

COMBUSTION HEAD FOR A BURNER

CROSS-REFERENCE TO RELATED APPLICATIONS

This patent application claims priority from Italian patent application no. 102020000021688 filed on Sep. 14, 2020, the entire disclosure of which is incorporated herein by reference.

TECHNICAL FIELD

The invention relates to a combustion head for a burner.

The invention especially finds advantageous application in combustion heads for liquid and gaseous fuel burners, to which explicit reference will be made in the description below without because of this loosing in generality.

BACKGROUND OF THE INVENTION

In the industry of liquid and gaseous fuel burners, it is known to provide a combustion head, which comprises an outer sleeve, which has a longitudinal axis and is provided with a fixing flange with a substantially quadrilateral shape, which radially projects outwards from an intermediate point of the sleeve and is fixed to a side wall of a combustion chamber of a boiler.

The sleeve has a first free end with a cylindrical shape, which extends on the outside of the combustion chamber and is connected to a pneumatic ventilation device, which is designed to feed an oxidizing air flow along the sleeve, and it further has a second free end with the shape of a truncated cone, which is arranged inside the combustion chamber.

The sleeve houses, on the inside, a first feeding device to feed a gaseous fuel flow to the second free end of the sleeve and into the oxidizing air fed to the second free end itself by the aforesaid pneumatic ventilation device.

The combustion head further comprises a swirl device, which is mounted inside the sleeve downstream of the first feeding device; an inner coupling with a cylindrical shape, which is fixed to a peripheral edge of the swirl device coaxial to the longitudinal axis of the combustion head; and an outer coupling, which is mounted between the inner coupling and the sleeve itself.

The combustion head further comprises a second feeding device, which is alternative to the first feeding device and is provided with a spraying nozzle, which is mounted at the centre of the inner coupling so as to feed a liquid fuel flow to the second free and of the sleeve and into the oxidizing air fed to the second free end itself by the aforesaid pneumatic ventilation device.

In use, the oxidizing air fed along the sleeve is partly channelled in the inner coupling so as to be mixed with the gaseous fuel fed through the first feeding device or with the liquid fuel fed through the second feeding device and generate a primary flow of fuel and oxidizing air.

The primary flow is fed through the swirl device, which is configured and oriented so as to cause the primary flow to make a helical movement around and along the aforesaid longitudinal axis and contain the combustion flame in a substantially cylindrical space.

Furthermore, the oxidizing air fed along the sleeve is channelled partly between the inner coupling and the outer coupling so as to generate a secondary flow of oxidizing air having, downstream of the combustion head, a relatively high axial speed, which is greater than the axial speed of the primary flow, and partly between the outer coupling and the sleeve so as to generate a tertiary flow of oxidizing air having, downstream of the combustion head, a relatively high axial speed.

The secondary flow and the tertiary flow cooperate with one another in order to keep the combustion flame in the aforesaid cylindrical space.

Known combustion heads of the type described above suffer from some drawbacks mainly arising from the fact that the use of relatively high liquid or gaseous fuel flow rates, which are necessary in order to ensure a correct thermal power of the boiler, leads to relatively high temperatures in the combustion chamber and, hence, to relatively high emissions of nitrogen oxides Nox, namely polluting agents that are harmful for human health.

SUMMARY OF THE INVENTION

The object of the invention is to provide a combustion head for a burner, which does not suffer from the drawbacks described above and can be manufactured in a simple and economic fashion.

According to the invention, there is provided a combustion head for a burner as claimed in the appended claims.

BRIEF DESCRIPTION OF THE DRAWINGS

The invention will now be described with reference to the accompanying drawings, showing a non-limiting embodiment thereof, wherein.

DETAILED DESCRIPTION OF THE INVENTION

Figure 1:
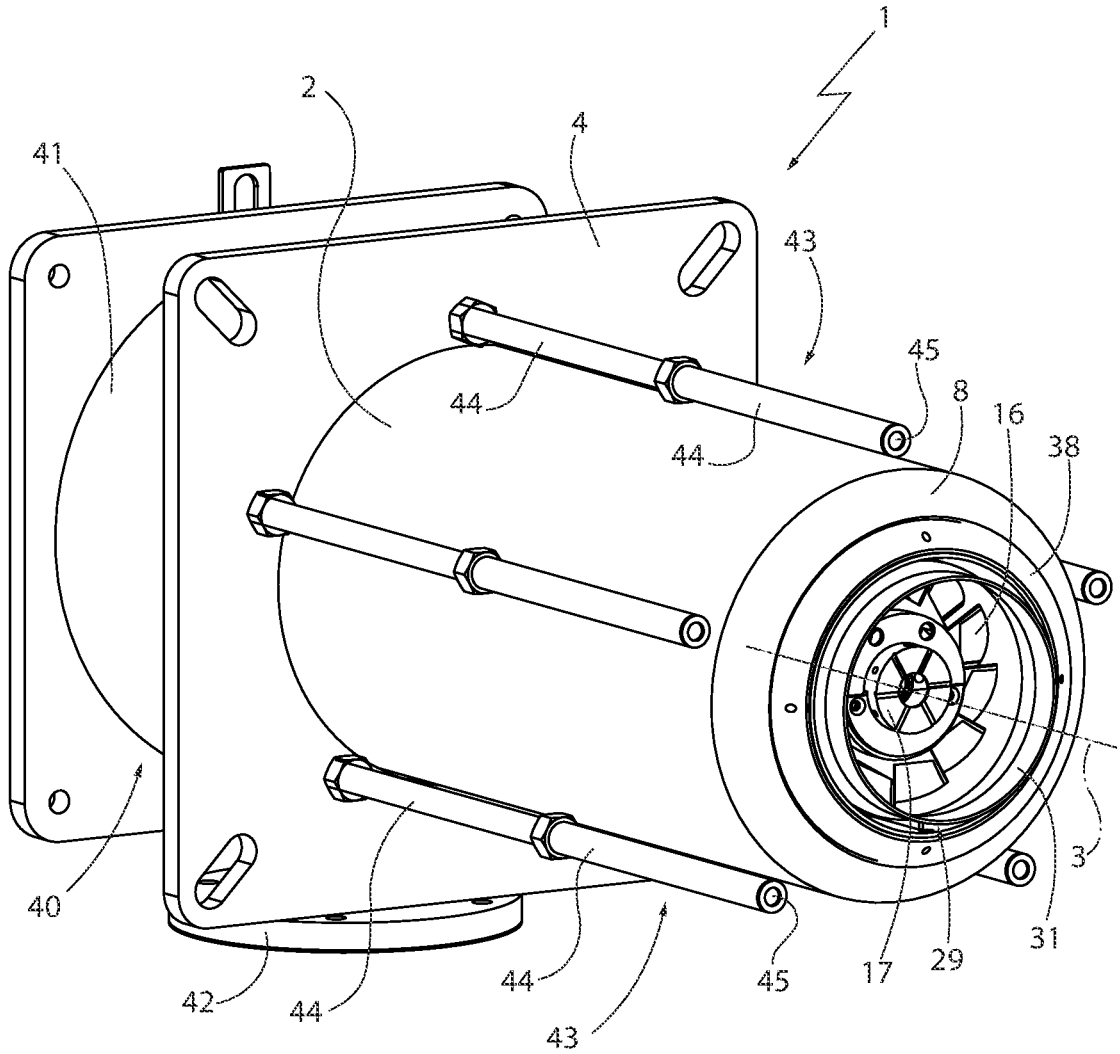
FIG. 1 is a schematic perspective view, with parts removed for greater clarity, of a preferred embodiment of the combustion head according to the invention.
Figure 2:
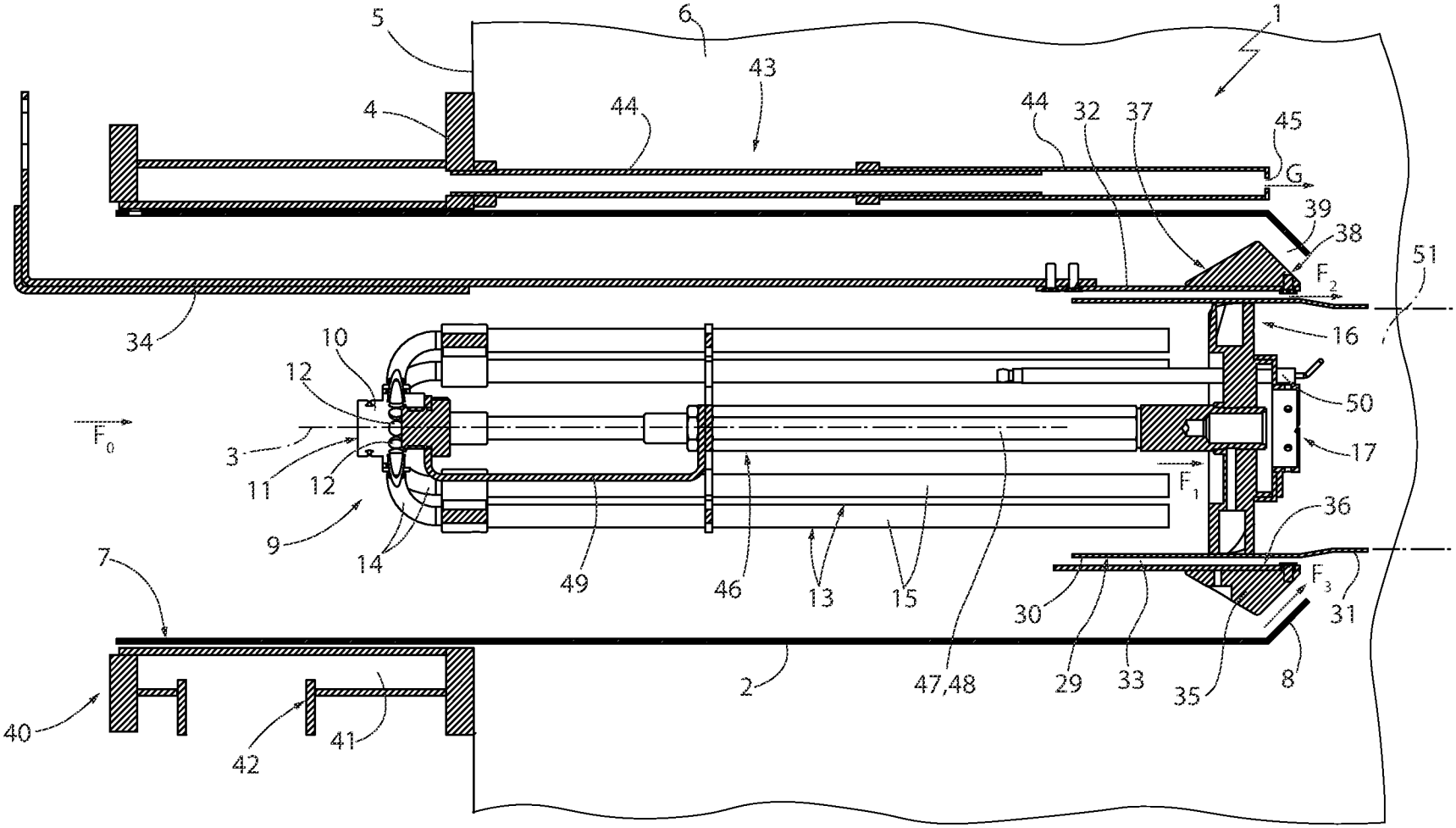
FIG. 2 is a schematic longitudinal section, with parts removed for greater clarity, of the combustion head of FIG. 1.

With reference to FIGS. 1 and 2, number 1 indicates, as a whole, a combustion head for a liquid and gaseous fuel burner.

The head 1 comprises an outer sleeve 2 with a cylindrical shape, which has a longitudinal axis 3 and is provided with a fixing flange 4 with a quadrilateral shape, which radially projects outwards from an intermediate point of the sleeve 2 and is fixed to a side wall 5 of a combustion chamber 6 of a boiler.

The sleeve 2 has a first free end 7 with a cylindrical shape, which extends on the outside of the chamber 6 and is connected to a pneumatic ventilation circuit (not shown), which is designed to feed oxidizing air along the sleeve 2, and it further has a second free end 8 with the shape of a truncated cone, which is arranged inside the chamber 6.

The sleeve 2 houses, on the inside, a first feeding device 9 to feed a gaseous fuel flow to the free end 8 of the sleeve 2 and into the oxidizing air fed to the free end itself by the aforesaid pneumatic ventilation circuit (not shown).

Figure 3:
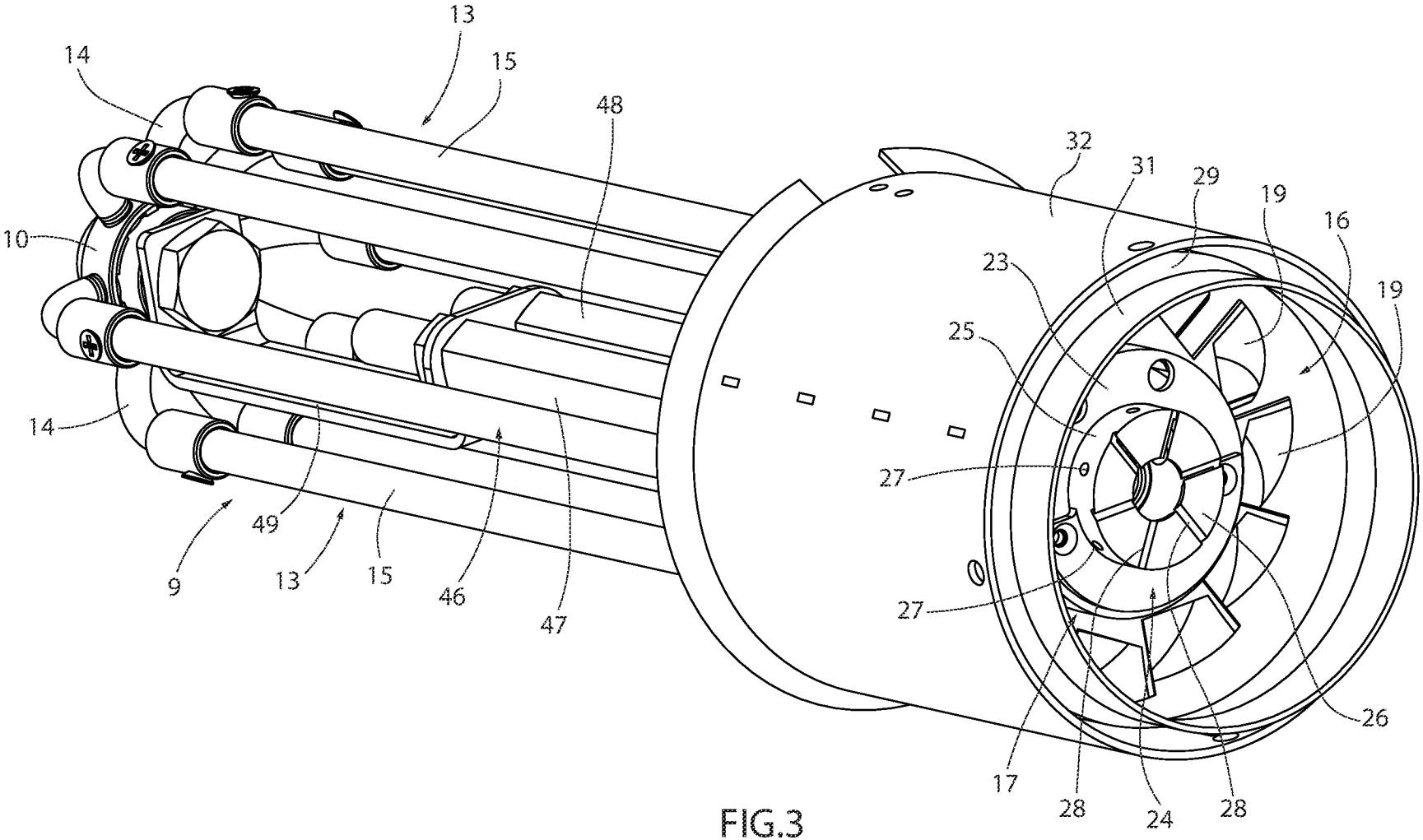
FIG. 3 is a schematic perspective view, with parts removed for greater clarity, of a first detail of the combustion head of FIGS. 1 and 2.

According to FIGS. 2 and 3, the device 9 comprises a distribution manifold 10 with a substantially cylindrical shape, which is mounted inside the sleeve 2 coaxially to the axis 3, has an axial inlet hole 11 connected to a gaseous fuel feeding duct (not shown) and has, furthermore, a plurality of radial outlet holes 12, which are uniformly distributed around the axis 3.

The device 9 is further provided with a plurality of feeding ducts 13, which are uniformly distributed around the axis 3 and each comprise a respective curved inlet segment 14, which is connected to a relative hole 12, and a respective straight outlet segment 15, which is substantially parallel to the axis 3.

The free ends of the segments 15 of the ducts 13 face a pair of swirl devices 16, 17, which are mounted inside the sleeve 2.

Figure 4:
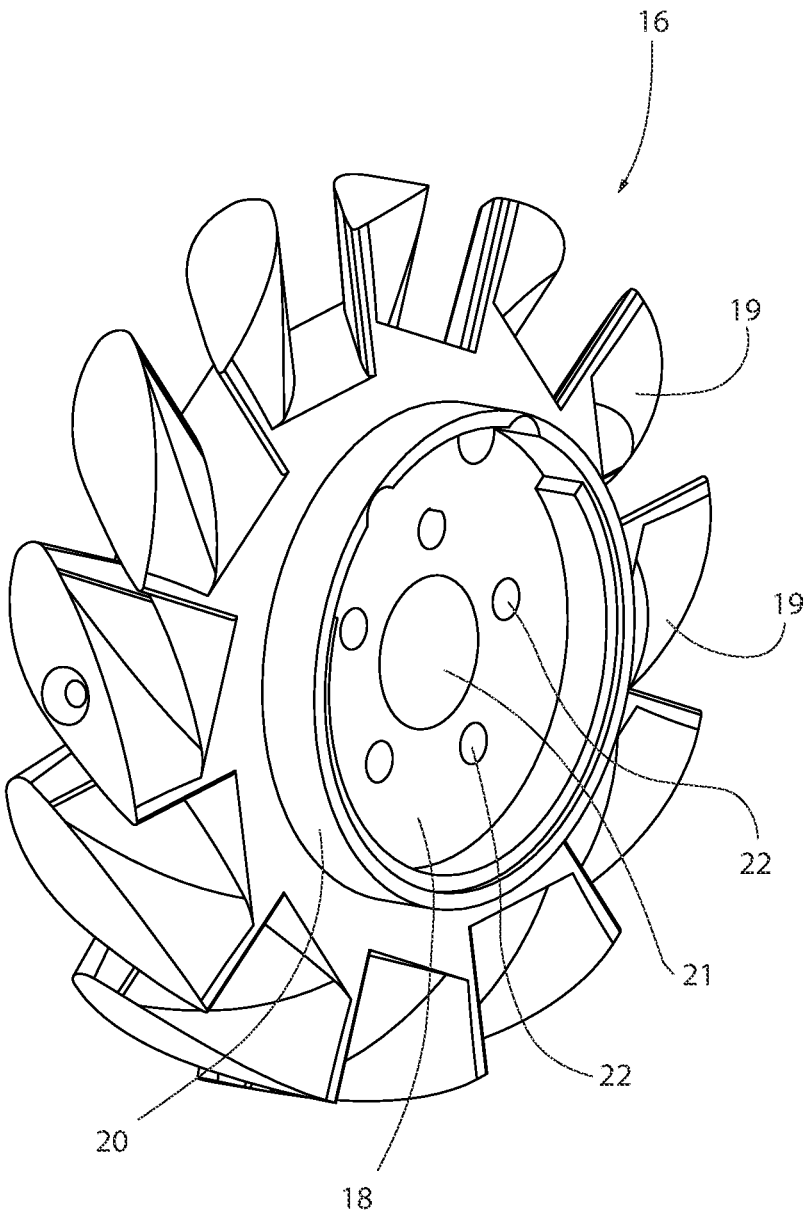
FIG. 4 is a schematic perspective view of a first detail of FIG. 3.
Figure 5:
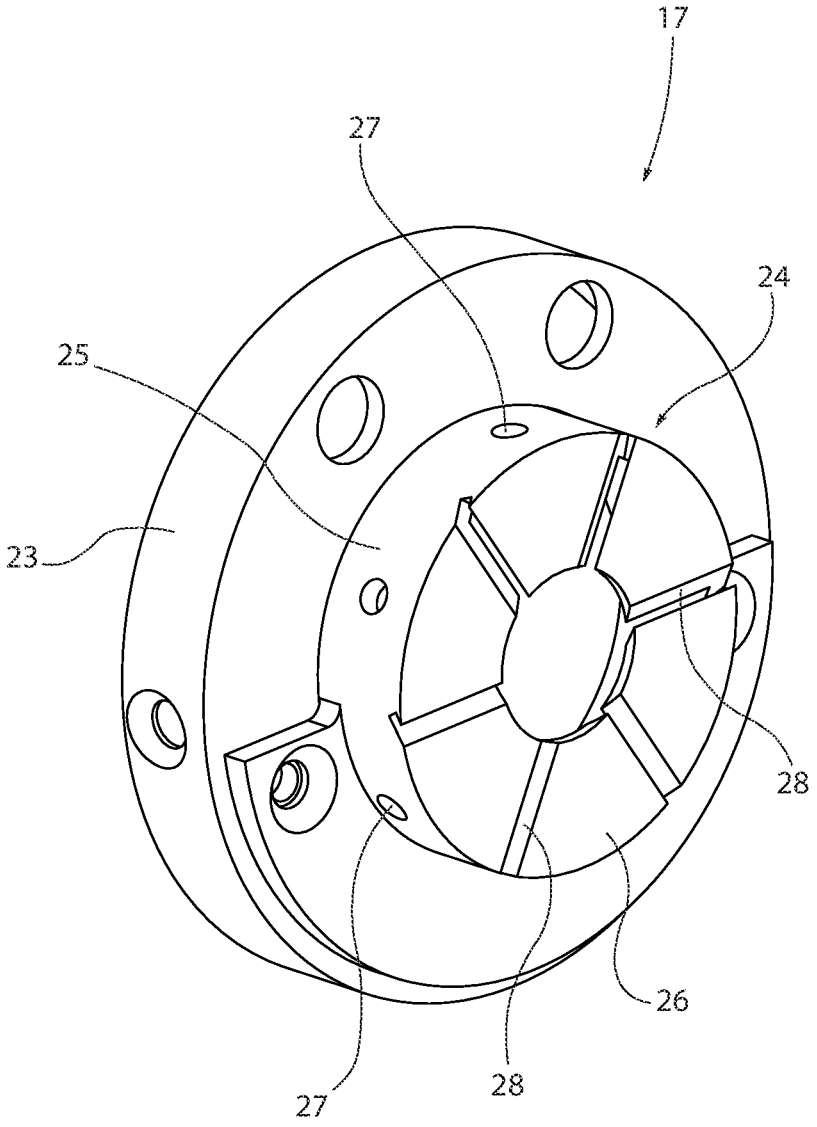
FIG. 5 is a schematic perspective view of a second detail of FIG. 3.

With reference to FIGS. 3, 4 and 5, the swirl device comprises a central plate 18 with an annular shape, which is mounted perpendicularly and coaxially to the axis 3, and a plurality of deflector blades 19, which are uniformly distributed around the axis 3 and project outwards from a peripheral edge of the plate 18.

The plate 18 has an annular centring collar 20, which axially projects from the plate 18 towards the free end 8, a hole 21, which is obtained through the plate 18 at the centre, coaxial to the axis 3, and a plurality of feeding holes 22, which are distributed around the axis 3 and are obtained through the plate 18, parallel to the axis 3.

The swirl device 17 has a tubular shape and comprises a wide portion 23, which is engaged on and fixed to the collar 20, and a narrow portion 24, which axially projects from the portion 23 towards the free end 8.

The portion 24 is fixed to the portion 23 in a releasable manner by means of a pair of fastening screws (not shown), is cup-shaped and is delimited by a side wall 25, which is substantially cylindrical and coaxial to the axis 3, and by an annular bottom wall 26, which is substantially flat and perpendicular to the axis 3.

The wall 25 is provided with a plurality of radial feeding holes 27, which are uniformly distributed around the axis 3 and are obtained through the wall 25 crosswise to the axis 3.

The wall 26 is provided with a plurality of feeding holes 28, which are uniformly distributed around the axis 3, extend through the wall 26 crosswise to the axis 3 and are inclined relative to the wall 26 at an angle ranging from 0° to 90°.

According to FIGS. 2 and 3, a first cylindrical coupling 29 is fixed to the blades 19 of the swirl device 16, is mounted coaxially to the axis 3, axially projects from the blades 19 and has an inlet end 30 and an outlet end 31, which axially projects outwards from the free end 8 and has a passage section that is smaller than a passage section of the end 30.

With regard to what discussed above, it should be pointed out that the outlet segments 15 of the gaseous fuel feeding ducts 13 axially project into the coupling 29.

The head 1 further comprises a second cylindrical coupling 32, which is mounted between the sleeve 2 and the coupling 29 coaxially to the axis 3 and defines, together with the coupling 29, a feeding channel 33 for the oxidizing air fed along the sleeve 2 by the pneumatic ventilation circuit (not shown).

The coupling 32 is coupled to the sleeve 2 in a sliding manner so as to make, relative to the sleeve 2 and to the coupling 29 and due to the thrust of a manually or motor-operated rod 34, straight movements parallel to the axis 3.

An annular shutter 35 is fixed to the coupling 32, is fitted on the coupling 32 coaxially to the axis 3, is delimited by a substantially cylindrical inner face 36 and is further delimited by an outer face, which is defined by two opposite surfaces 37, 38 with the shape of a truncated cone.

The surface 38 substantially has the same taper as the free end 8 and defines, together with the free end 8, a feeding channel 39 for the oxidizing air fed along the sleeve 2 by the aforesaid pneumatic ventilation circuit (nor shown).

The shutter 35 is moved by the rod 34 parallel to the axis 3 so as to selectively control a passage section of the channel 39, in particular between a closed position and at least one open position of the channel 39.

Figure 6:
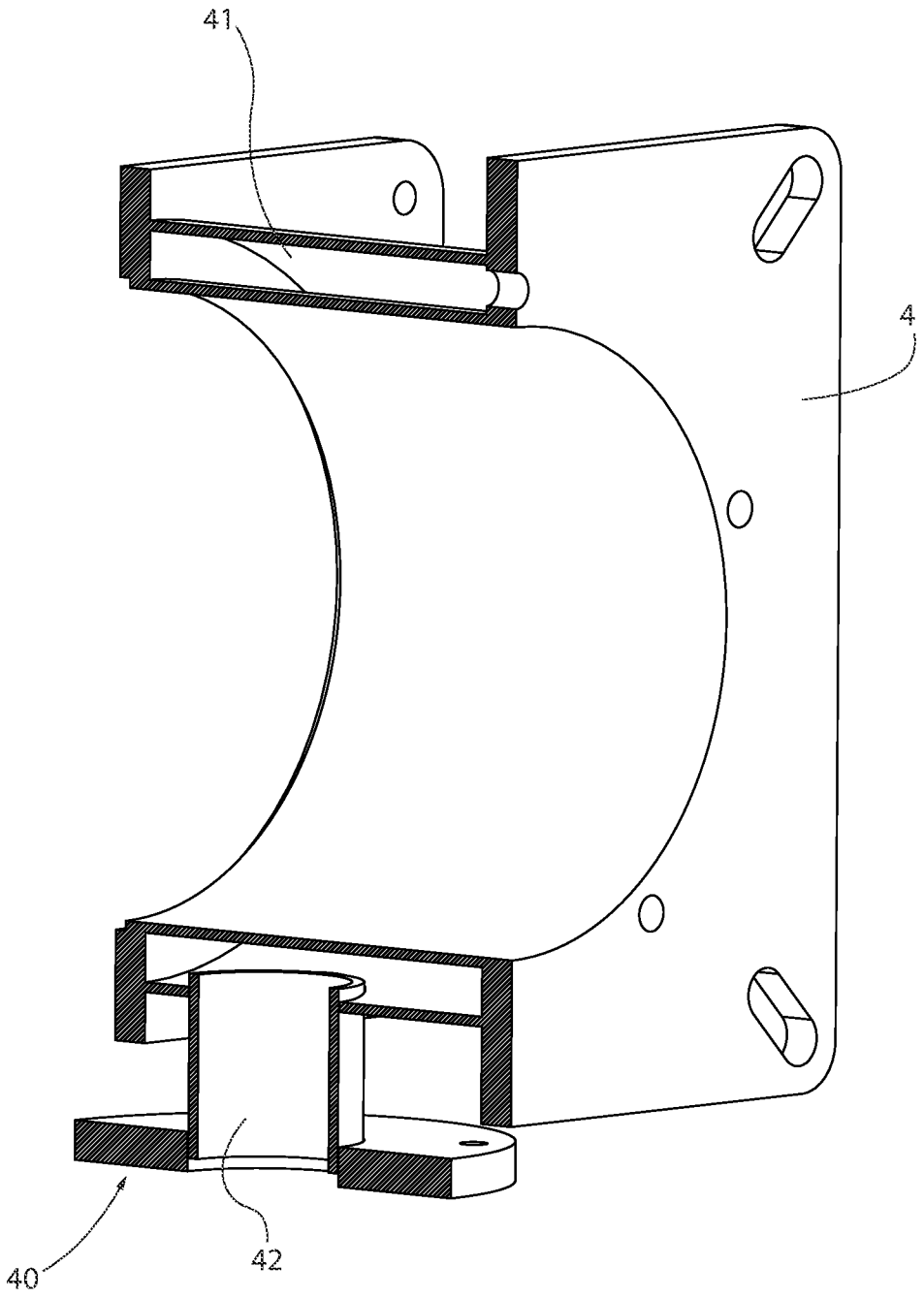
FIG. 6 is a schematic perspective view, with parts removed for greater clarity, of a second detail of the combustion head of FIGS. 1 and 2.

With reference to FIGS. 1, 2 and 6, the head 1 further comprises a second feeding device 40, which is mounted on the outside of the sleeve 2 in order to feed a gaseous fuel flow into the combustion chamber 6.

The device 40 comprises a distribution manifold 41 with an annular shape, which extends on the outside of the chamber 6, is fitted on the free end 7 coaxially to the axis 3 and has an inlet hole 42 connected to a gaseous fuel feeding duct (not shown).

The device 40 further comprises a plurality of feeding ducts 43, which are uniformly distributed around the axis 3, are mounted inside the chamber 6 and extend through the flange 4 in order to be connected to the manifold 41.

Each duct 43 comprises two telescopic segments 44, which are connected to one another in a sliding manner so as to selectively control a length of the duct 43, and is provided with an outlet hole 45 having a passage section that is smaller than a passage section of the segments 44.

According to FIGS. 2 and 3, the head 1 further comprises a third feeding device 46, which is alternative to the gaseous fuel feeding devices 9, 40 and is mounted inside the sleeve 2 in order to feed a liquid fuel flow to the free end 8 and into the oxidizing air fed to the free end 8 by the aforesaid pneumatic ventilation circuit (not shown).

The device 46 comprises a spraying nozzle (not shown), which is mounted through the wide portion 23 and the narrow portion 24 of the swirl device 17 and through the central hole 21 of the swirl device 16.

The device 46 further comprises a feeding duct 47 to feed liquid fuel to the spraying nozzle (not shown) and a draining duct 48 to drain the excess liquid fuel from the spraying nozzle (not shown).

The ducts 47, 48 are mounted in the central area within the outlet segments 15 of the feeding ducts 13 parallel to the axis 3 and are fixed to a support bracket 49, which is coupled to the distribution manifold 10.

The head 1 finally comprises a pair of firing electrodes 50 (only one of them being shown in FIG. 2), which are mounted through the swirl devices 16, 17 and project from the swirl devices 16, 17 so as to cooperate with the gaseous fuel fed to the free end 8 by the device 9 and with the liquid fuel fed to the free end 8 by the device 46.

The operation of the combustion head 1 will be described, first of all, assuming that gaseous fuel is fed by means of the devices 9, 40 and starting from an instant in which the shutter 35 is arranged in an open position of the feeding channel 39.

The aforesaid pneumatic ventilation circuit (not shown) feeds an oxidizing air flow $F_0$ along the sleeve 2 from the free end 7 to the free end 8.

The flow $F_0$ is partly channelled inside the coupling 29 so as to be mixed with the gaseous fuel fed through the feeding ducts 13 and generate a primary flow $F_1$ of gaseous fuel and oxidizing air.

The primary fuel $F_1$ is fed through the swirl device 16 and, hence, the deflector blades 19 and is further fed through the feeding holes 22, the swirl device 17 and, hence, the feeding holes 27 and the feeding channels 28.

The blades 19, the holes 27 and the channels 28 are configured and oriented so as to cause the primary flow $F_1$ to make a helical movement around and along the aforesaid axis 3 and contain the combustion flame, which is initially generated by the electrodes 50, in a cylindrical space 51 having a passage section that is, at most, equal to the passage section of the outlet end 31 of the coupling 29.

The flow $F_0$ further is partly channelled along the feeding channel 33 between the inner coupling 29 and the outer coupling 32 so as to generate a secondary oxidizing air flow $F_2$ having, downstream of the head 1, a relatively high axial speed.

The flow $F_0$ further is partly channelled between the coupling 32 and the sleeve 2 and along the feeding channel so as to generate a tertiary oxidizing air flow $F_3$, which has, downstream of the head 1, an initial speed, which is inclined towards the axis 3 with the same orientation as the free end 8, and a final speed, which is substantially parallel to the axis 3.

The helical movement transmitted by the swirl devices 16, 17 to the primary flow $F_1$ and the orientation of the secondary flow $F_2$ and of the tertiary flow $F_3$ allow, on the one hand, the combustion flame to be kept inside the space 51 and, on the other hand, the combustion fumes, which are generated by the combustion flame and are present inside the chamber 6, to be recirculated through depression, first of all from the bottom of the chamber 6 to the head 1 and, then, along the space 51.

Fluid-dynamics studies have shown that combustion fumes place themselves, downstream of the head 1, between the outer surface of the space 51 and the oxidizing air flow F2.

The feeding device 40 feeds a further gaseous fuel flow G into the combustion chamber 6 downstream of the head 1 and of the sleeve 2.

The flow G has a relatively high moving speed, which is substantially parallel to the axis 3 and is selectively controlled depending on the passage section of the outlet holes 45 of the feeding ducts 43.

The flow G is kept substantially separate from the combustion flame contained in the space 51 both by its moving speed and by the action of the secondary flow $F_2$ and of the tertiary flow $F_3$.

As a consequence, the flow G does not burn in the area of the free end 8 of the head 1 and reaches a temperature that is sufficient to start chemical oxidation reactions at a relatively large distance from the free end 8.

The substantial separation of the flow G from the space 51 and, hence, from the combustion flame, the recirculation of the combustion fumes between the combustion flame and the flow G and the combustion of the flow G at a relatively large distance from the free end 8 allow heat to be removed from the space 51 through the recirculation of the combustion fumes, thus limiting the maximum temperature of the combustion flame and limiting the formation of nitrogen oxides Nox, which is particularly sensitive at temperatures exceeding 1100°.

The operation of the combustion head 1 will now be described assuming that liquid fuel is fed by means of the feeding device 46.

Liquid fuel is injected by the aforesaid spraying nozzle (not shown) downstream of the head 1 so as to generate a flow $F_4$ of oxidizing air and liquid fuel having a relatively high axial moving speed.

The axial moving speed of the flow $F_4$ and the orientation of the secondary flow $F_2$ and of the tertiary flow $F_3$ allow, on the one hand, the combustion flame to be kept inside the space 51 and, on the other hand, combustion fumes, which are generated by the combustion flame and are present inside chamber 6, to be recirculated along the space 51 so as to remove heat from the space 51 through the recirculation of the combustion fumes, thus limiting the maximum temperature of the combustion flame and limiting the formation of nitrogen oxides Nox.

According to a variant which is not shown herein, the feeding device 46 is eliminated and the combustion head 1 is exclusively fed with gaseous fuel.

Figure 7:
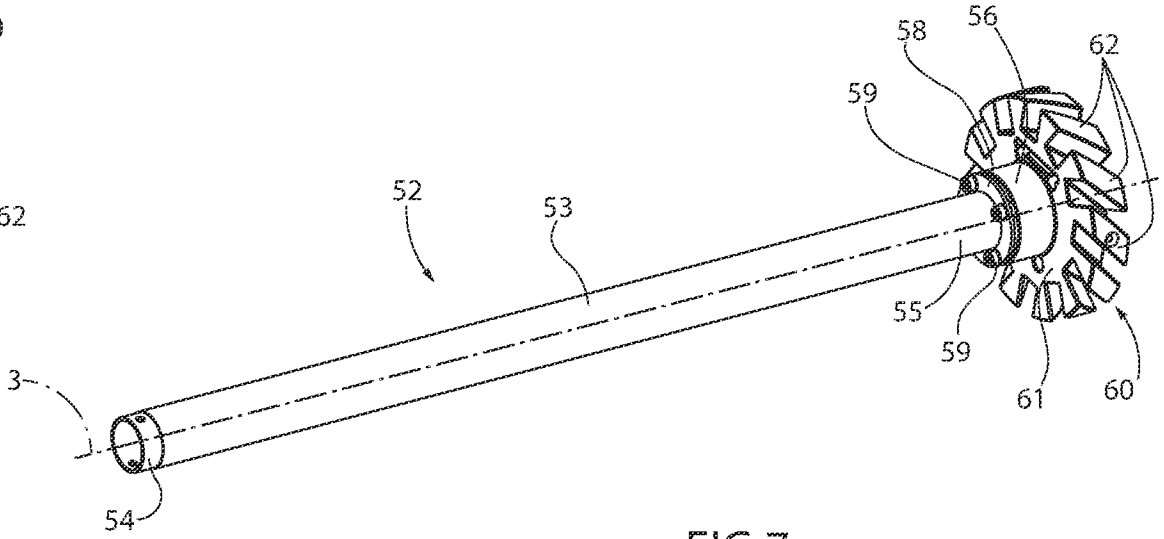
FIG. 7 shows a schematic perspective view, with parts removed for greater clarity, of a variant of a detail of the combustion head of FIG. 1.
Figure 8:
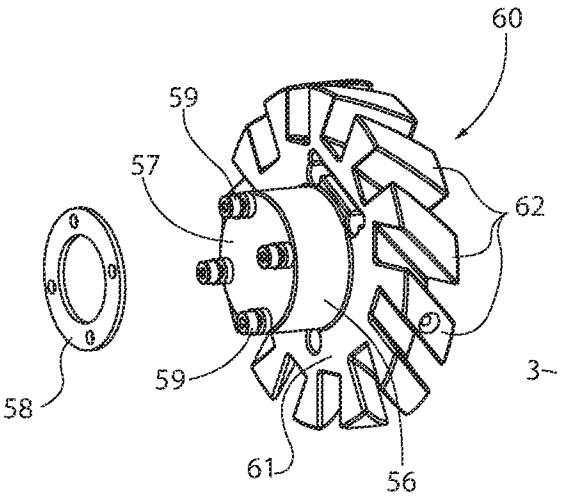
FIG. 8 is a schematic perspective view of a detail of FIG. 7.

The variant shown in FIGS. 7 and 8 differs from the preceding figures only in that, in said variant, the feeding device 9 and the swirl devices 16, 17 are eliminated and replaced by a feeding device 52 to feed a gaseous fuel flow to the free end 8 of the sleeve 2 and into the oxidizing air fed to the free end 8 by the aforesaid pneumatic ventilation circuit (not shown).

The device 52 comprises a feeding duct 53, which is mounted inside the sleeve 2 coaxially to the axis 3, has an inlet end 54 and further has an outlet end 55 opposite the end 54.

The device 52 further comprises a deflector block 56 with a cylindrical shape, which is fixed downstream of the duct 53 coaxially to the axis 3, is axially delimited by a face 57 facing the end 55 and is arranged at a given distance from the end 55 in order to allow the gaseous fuel to flow out of the duct 53.

The outflow of the gaseous fuel from the duct 53 is selectively controlled by an annular washer 58, which is mounted around the end 55 coaxially to the axis 3 and is fixed to the block 56 by means of a plurality of adjustment screws 59, which are designed to selectively control the distance of the washer 58 from the face 57 and, hence, the gaseous fuel flow rate fed into the oxidizing air.

The gaseous fuel is fed, first of all, along the duct 53 parallel to the axis 3, then between the face 57 and the washer 58 crosswise to the axis 3 and, finally, through a swirl device 60 comprising a central hub 61 with an annular shape, which is fixed around the block 56 coaxially to the axis 3, and a plurality of deflector blades 62, which are uniformly distributed around the axis 3 and project outwards from a peripheral edge of the hub 61.

The invention claimed is:

1. A combustion head for a burner, the combustion head comprising an outer sleeve (2), which has a longitudinal axis (3) and is provided with a first free end (7) connected to a pneumatic ventilation device designed to feed oxidizing air along the outer sleeve (2); a first feeding device (9; 52), which is mounted in the outer sleeve (2) in order to feed a gaseous fuel to a second free end (8) of the outer sleeve (2) and into the oxidizing air; at least one first swirl device (17; 60), which is mounted in the outer sleeve (2) so as to cause a primary flow $F_1$ of gaseous fuel and oxidizing air to make a helical movement around and along said longitudinal axis (3); and at least one first feeding channel (33) with an annular shape, which is obtained between the outer sleeve (2) and the first swirl device (17; 60) and is pneumatically connected to the first free end (7) of the outer sleeve (2) in order to feed a secondary flow $F_2$ of oxidizing air around the primary flow $F_1$; and being characterized in that it further comprises a second feeding device (40), which is mounted on the outside of the outer sleeve (2) and is connected to a gaseous fuel source, wherein the second feeding device (40) comprises a plurality of second feeding ducts (43), which are mounted on the outside of the outer sleeve (2) and parallel to said longitudinal axis (3), and wherein each second feeding duct (43) has an outlet hole (45) and a variable length so as to selectively control the axial position of the outlet hole (45) relative to the second free end (8) of the outer sleeve (2).

2. A combustion head according to claim 1, wherein the first feeding device (9) comprises a plurality of first feeding ducts (13), which are housed inside the outer sleeve (2), axially project downstream of an inlet of the first feeding channel (33) and face the first swirl device (17).

3. A combustion head according to claim 2, wherein the first feeding device (9) further comprises a first distribution manifold (10), which is mounted inside the outer sleeve (2) and is connected to the first feeding ducts (13).

4. A combustion head according to claim 1, wherein the outlet hole (45) has a smaller passage section than a passage section of the second feeding duct (43).

5. A combustion head according to claim 1, wherein the second feeding device (40) further comprises a second distribution manifold (41), which is mounted on the outside of the outer sleeve (2) and is connected to the second feeding ducts (43).

6. A combustion head for a burner, the combustion head comprising an outer sleeve (2), which has a longitudinal axis (3) and is provided with a first free end (7) connected to a pneumatic ventilation device designed to feed oxidizing air along the outer sleeve (2); a first feeding device (9; 52), which is mounted in the outer sleeve (2) in order to feed a gaseous fuel to a second free end (8) of the outer sleeve (2) and into the oxidizing air; at least one first swirl device (17; 60), which is mounted in the outer sleeve (2) so as to cause a primary flow $F_1$ of gaseous fuel and oxidizing air to make a helical movement around and along said longitudinal axis (3); and at least one first feeding channel (33) with an annular shape, which is obtained between the outer sleeve (2) and the first swirl device (17; 60) and is pneumatically connected to the first free end (7) of the outer sleeve (2) in order to feed a secondary flow $F_2$ of oxidizing air around the primary flow $F_1$; and being characterized in that it further comprises a second feeding device (40), which is mounted on the outside of the outer sleeve (2) and is connected to a gaseous fuel source; wherein the first swirl device (17) has a tubular shape, is delimited by a side wall (25) extending around said longitudinal axis (3) and is further delimited by a bottom wall (26), which is substantially perpendicular to the longitudinal axis (3), wherein the first swirl device (17) has a plurality of feeding holes (27), which are obtained through the side wall (25) crosswise to said longitudinal axis (3), and a plurality of feeding channels (28), which are obtained through the bottom wall (26) and are inclined according to an angle ranging from 0° to 90° relative to the bottom wall (26).

7. A combustion head according to claim 1 and further comprising a second swirl device (16), which cooperates with the first swirl device (17) so as to cause the primary flow $F_1$ to make the helical movement around and along said longitudinal axis (3), extends around the first swirl device (17) and has a plurality of deflector blades (19), which are distributed around the longitudinal axis (3).

8. A combustion head for a burner, the combustion head comprising an outer sleeve (2), which has a longitudinal axis (3) and is provided with a first free end (7) connected to a pneumatic ventilation device designed to feed oxidizing air along the outer sleeve (2); a first feeding device (9; 52), which is mounted in the outer sleeve (2) in order to feed a gaseous fuel to a second free end (8) of the outer sleeve (2) and into the oxidizing air; at least one first swirl device (17; 60), which is mounted in the outer sleeve (2) so as to cause a primary flow $F_1$ of gaseous fuel and oxidizing air to make a helical movement around and along said longitudinal axis (3); and at least one first feeding channel (33) with an annular shape, which is obtained between the outer sleeve (2) and the first swirl device (17; 60) and is pneumatically connected to the first free end (7) of the outer sleeve (2) in order to feed a secondary flow $F_2$ of oxidizing air around the primary flow $F_1$; and being characterized in that it further comprises a second feeding device (40), which is mounted on the outside of the outer sleeve (2) and is connected to a gaseous fuel source; the combustion head further comprising a second feeding channel (39) with an annular shape, which is obtained between the outer sleeve (2) and the first feeding channel (33) and is pneumatically connected to the first free end (7) of the outer sleeve (2) so as to feed a tertiary flow $F_3$ of oxidizing air around the primary flow $F_1$.

9. A combustion head according to claim 8 and further comprising a shutter member (35), which is movable between a closing position and an opening position to close and open the feeding channel (39).

10. A combustion head according to claim 9, wherein the second free end (8) of the outer sleeve (2) substantially has the shape of a truncated cone and defines, together with a surface (38) of the shutter member (35) substantially having the shape of a truncated cone, the second feeding channel (39).

11. A combustion head according to claim 1 and further comprising a third feeding device (46), which is mounted in the outer sleeve (2) so as to feed a liquid fuel to the second free end (8) of the outer sleeve (2) and into the oxidizing air.

12. A combustion head according to claim 11, wherein the third feeding device (46) comprises an atomizing nozzle, which is mounted through the first swirl device (17).

13. A combustion head for a burner, the combustion head comprising an outer sleeve (2), which has a longitudinal axis (3) and is provided with a first free end (7) connected to a pneumatic ventilation device designed to feed oxidizing air along the outer sleeve (2); a first feeding device (9; 52), which is mounted in the outer sleeve (2) in order to feed a gaseous fuel to a second free end (8) of the outer sleeve (2) and into the oxidizing air; at least one first swirl device (17; 60), which is mounted in the outer sleeve (2) so as to cause a primary flow $F_1$ of gaseous fuel and oxidizing air to make a helical movement around and along said longitudinal axis (3); and at least one first feeding channel (33) with an annular shape, which is obtained between the outer sleeve (2) and the first swirl device (17; 60) and is pneumatically connected to the first free end (7) of the outer sleeve (2) in order to feed a secondary flow $F_2$ of oxidizing air around the primary flow $F_1$; and being characterized in that it further comprises a second feeding device (40), which is mounted on the outside of the outer sleeve (2) and is connected to a gaseous fuel source; wherein the first feeding device (52) comprises a feeding duct (53), which is housed inside the outer sleeve (2), and a deflector block (56), which faces an outlet end (55) of the feeding duct (53); the feeding duct (53) and the deflector block (56) being arranged at a given distance from one another so as to allow the gaseous fuel to be fed through the outlet end (55).

14. A combustion head according to claim 13, wherein the first feeding device (52) further comprises an adjustment washer (58), which is fitted around the outlet end (55) and is arranged at a variable distance from the deflector block (56) so as to selectively control the gaseous fuel flow rate fed through the outlet end (55).

* * * * *